US005735513A

United States Patent [19]

Toffolon

[11] Patent Number: 5,735,513

[45] Date of Patent: Apr. 7, 1998

[54] MULTI-STATION SINGLE ACTION HIGH PRECISION MECHANICAL VISE

[75] Inventor: Joseph F. Toffolon, 9587B S.W. 84th Ter., Ocala, Fla. 34481

[73] Assignee: Joseph F. Toffolon, Ocala, Fla.

[21] Appl. No.: 616,694

[22] Filed: Mar. 15, 1996

[51] Int. Cl.[6] ..... B25B 1/20

[52] U.S. Cl. ..... 269/43; 269/153; 269/154; 269/234; 269/138

[58] Field of Search ..... 269/99–101, 138, 269/234, 152, 153, 154, 254 R, 43, 906

[56] References Cited

U.S. PATENT DOCUMENTS

| | | | |
|---|---|---|---|
| 2,564,138 | 8/1951 | Walker | 269/138 |
| 4,643,411 | 2/1987 | Izumi | 269/138 |
| 4,804,171 | 2/1989 | Dornfeld | 269/234 |
| 4,934,674 | 6/1990 | Bernstein | 269/43 |

OTHER PUBLICATIONS

Manhattan Supplies Company's Catalog, p. 1021 Published Aug. 1995.

*Primary Examiner*—Robert C. Watson
*Attorney, Agent, or Firm*—Stein, Pendorf & Van Der Wall

[57] ABSTRACT

A multi-station, single action high precision mechanical vise for simultaneously clamping at least two work pieces with high dimensional stability and high holding forces. The multi-station work piece holder is used to hold a set of work pieces, so that sets of machining operations can be performed on the work pieces using the same tool, reducing the number of work tool change-outs needed when producing a large number of machined pieces.

10 Claims, 5 Drawing Sheets

MULTI-STATION SINGLE ACTION HIGH PRECISION MECHANICAL VISE

BACKGROUND OF THE INVENTION

1. Field of the Invention

The invention concerns a multi-station, single action high precision mechanical vise for simultaneously clamping at least two work pieces with high dimensional stability and high holding forces. The multi-station work piece holder is used to hold a set of work pieces, so that sets of machining operations can be performed on the work pieces using the same tool.

The vise is compact, is automatically reset to a zero reference point after each clamping operation, has high workpiece positioning dimensional accuracy, can be easily set up to hold parts of different dimensions without changing the zero reference point, and is quick acting (i.e., tightening and release).

2. Description of the Related Art

In the machining of work pieces it is known to perform one or more operations, such as drilling, boring, milling, turning, shaping, spot welding, polishing, etc., on a large number of work pieces, generally one after the other. It is known to use a computer numerical controlled (CNC-controlled) milling and drilling machine to control a workhead of spindle mounted on guideways and displacable in three quadrant direction, that is, in the X-Y-Z directions. With the help of the CNC-controller, it is possible to select a tool from a magazine, to convey the tool exactly into position with respect to the work piece to be processed, to perform the desired operation, to return the tool to a storage magazine, and to select the next tool for carrying out the next process.

In order to machine on one work piece it may be necessary to employ, for example, four different tools. In such a case, a first tool must be retrieved from a work tool storage magazine, mounted on a workhead or spindle, conveyed to the work piece, the machining operation performed, and the work tool returned to the work tool storage magazine and exchanged for a second work tool. Even though the process is automated, it may take, in general, approximately 10 seconds for each change out operation. In the case of requiring four work tools to machine one work piece, the time spent just on changing out tools may be 40 seconds. For this reason, attempts have been made to set up multi-station vises. Obviously, if the work pieces are to be machined with a CNC milling or drilling machine, in addition to being able to present as many work pieces to a spindle or workhead as possible the vise must also be capable of securing work pieces with high dimensional accuracy. Forces acting upon the work piece may be very large, and it is thus necessary to securely clamp the work piece in the vise to prevent any movement of the work piece. It is thus necessary to apply a large amount of force through the jaws to the work piece in order to prevent movement of the work piece during the working operation.

There is also a need for a vise which can hold work pieces of different sizes, or different aspects of the same work piece, and thus is capable of having independently adjustable work spaces. For example, a given work piece may be secured in a first work station in order to present at least one face of the work piece to the workhead or spindle in order to perform a first set of operations on the work piece. Thereafter, the first work piece may be transferred to a second work station where it can be reoriented to present one or more previously masked faces to the work tool. Since a work piece is usually not a perfectly square, i.e., since the dimensions along each edge are usually not identical, the space required to clamp the work piece in the second work station is generally different from the clamping space of the first work station. Thus, the multi-station vise must be capable of securely holding work pieces of different sizes, yet with great dimensional stability, great strength, and preferably without having to reposition the zero-reference point when setting up work stations of uneven sizes.

To those not familiar with the art and desiring to machine two workpieces at the same time, it may seem logical to simply clamp two or more work pieces between the jaws of a single vise and then to perform the machining operation on both work pieces. However, those working in this art will immediately understand that such an approach will not yield a satisfactorily result since both work pieces must be positioned precisely with respect to a reference point, and any deviation in the desired dimension at which the work pieces being held will cause undesired deviations in the location of the features machined into one or both work pieces. Further, if each work piece is not held securely between two jaws, there is an increased likelihood of creep or displacement due to the high mechanical forces of machining.

With the above in mind, several companies have developed multi-station, single action vises. Two concepts are central to such a vise. First, the vise must be capable of securely, and with high dimensional stability, holding more than one part at a time. Second, the vise must tighten on and securely hold all parts with a single hand operation. That is, only one manipulation step should be required to simultaneously tighten two more work pieces in place.

One such double acting vise was developed by Krason, et. al. and described in U.S. Pat. No. 4,529,183. A vise is described with a first and second pair of jaws, each jaw pair having a member which is fixedly located with respect to a reference location, and a second jaw member which can open or close upon rotating a single screw shaft. However, this type of vise has a number of deficiencies. Most significantly, the amount of tensional holding forces capable of being applied to the work pieces is limited due to the screw type single action vise jaw actuating means. Further, the screw type mechanism takes up a large amount of space.

In U.S. Pat. No. 4,934,674 Burnstein describes a two-station, single action vise having a body, with a fixed center block forming oppositely facing fixed jaws, and moveable jaws at opposite ends of the body that are moved towards or away from their respective counterpart fixed jaw in the center of the body by operation by a single vise screw. That is, one of the moveable jaws is operated by a vise screw that has a left hand thread and one of the moveable jaws is operated by a different part of the same screw having a right hand thread, so that as a single screw is rotated, both moveable jaws move simultaneously towards the center block forming the fixed jaws. The vise screw can be adjusted axially relative to the vise body to shift one moveable jaw relative to the fixed jaw to a different position from the first jaw for the purposes of permitting different size parts to be clamped by the respective jaws. However, this is a complex operation and does not guarantee that the zero reference point will be maintained. This double vise inherits the problems associated with previous double vises.

U.S. Pat. No. 5,242,159 to Burnstein teaches a double lock vise wherein the mechanical tensioning means is replaced by a hydraulic tensioning means. However, a hydraulic vise is mechanically complex, ecologically undesirable, liable to breakdowns, and expensive, and is thus usually not a vise of choice.

Recently a system was developed wherein a series of micro-clamp modules may be mounted on a universal T-slot base plate. One side of each micro-clamp module has a solid, fixed jaw. The other side of the same module has a down-pressure jaw comprising a vise block having a inclined surface mounted upon a base inclined surface. Tightening a screw draws the vise block simultaneously downwards and axially outwards, thereby clamping a workpiece between the movable integrated down pressure jaw and the solid jaw of the mixed clamped module. Although the vise is space saving, and although a series of work pieces can be clamped between each set of micro-clamp modules, it is not possible to secure multiple work pieces with one single tightening or torquing action. Further, tightening the vise block downwards and outwards results in the face of the vise block contacting the work piece being arrested against moving downwards once it contacts the work piece. Since the opposite side of the vise block continues to be drawn downwards, the vise jaw is caused to tilt slightly and exert a pressure which is are not perfectly orthogonal and more linear than planar. Examples of such a clamping system include a micro-clamp produced by Triag and an edge clamp module mini-vise produced by Jergens of Cleveland, Ohio.

Recently a clamp capable of holding two parts with equal lateral clamping action has been offered by Mitee-Bite Products Company. The device comprises a wedge block tapered in the downward direction and seated within a generally U-shaped member. The U-shaped member comprises a base platform and two uprights, each upright having an inward facing inclined surface which is flush with the corresponding contacting face of the wedge block, and an outward facing surface which is intended to be perpendicular to the direction of exertion of the clamping force. A screw passes through a borehole in the base of the U-shaped member and is screwed into a threaded borehole of the wedge block. Tightening the screw causes the wedge block to be drawn down into the U-shaped member, simultaneously causing the uprights to spread apart.

Although this clamp is advantageous in its ability to two parts with equal lateral clamping action by the tightening of a single screw, it exhibits a number of deficiencies. First, the wedge block and the vertical uprights of the U-shaped member float and are not realigned to a central registry or reference point after each operation, reducing dimensional precision. Second, the wedge block has an amount of play which permits the wedge block to deviate upon tightening. Third, the tightening of the wedge block initiates a greater spreading action at the top of the U-shaped member than at the bottom of the U-shaped member, causing the outward facing surfaces of the U-shaped member (generally referred to as vise plates) to exert a force tangentially against the work piece greater at the top rather than at the bottom, so that the clamping or holding force is exerted along a line rather than spread over the entire face of the vise plates, so that there is less of an effective contact surface. Fourth, drawing the wedge plate downwards to the base plate causes a small but significant distortion of the base plate upon which the clamp is mounted. Accordingly, since the base plate and thus the held part may be slightly tilted, dimensional accuracy of the machining of the clamped part cannot be guaranteed. This dimensional accuracy is critical in the case that the vise is to be used with a CNC type automatic machining process.

The present inventor has extensively investigated multi-station vises which have been developed to date, and finds that they either do not quickly and easily permit securing of multiple work pieces of different dimensions without changing the zero reference point, do not distribute the holding force of the vise jaws against the work piece in a planar manner, or tend to buckle or deform during tightening, thereby loosing dimensional stability.

There is thus a need for a multi-station, single acting vise which does not suffer from the above disadvantages.

SUMMARY OF THE INVENTION

After extensive investigation, prototyping and development, the present inventor discovered that it would be possible to make a two-station, single action high precision mechanical vise for simultaneously clamping two work pieces to be worked upon which does not suffer the deficiencies described above.

The inventor has discovered that the deficiencies can be avoided by providing a double vise with a centrally located tightening mechanism based upon a wedge block design, wherein tightening is accomplished by drawing the wedge block upwardly away from the base plate rather than downward toward the base plate. As result of the reorienting of the activation direction of the wedge block and other structural features described below, the vise of the present invention achieves greater dimensional stability, greater holding forces, greater evenness of holding forces, and greater compactness than hitherto possible.

The vise according to the present invention further comprises an integrated fixed stop which serves as a reference point for resetting the vise jaws to the same starting position between each clamping operation, thereby guaranteeing high dimensional accuracy in the positioning of work pieces.

Further, the vise according to the invention is more compact and at the same time is capable of rendering greater holding forces than a screw-type two station vise. The compactness of the vise makes it possible to position more work pieces in the work area of a CNC milling or drilling machine, so that a greater number of pieces can be processed during each machining operation. This feature becomes more significant with the greater number of tools, and thus the greater number of tool change outs, needed to process a work piece.

Accordingly, the vise according to the present invention comprises a base plate, a moveable jaw assembly mounted centrally on the base plate with axially displaceable jaws, guide rails extending axially outwards away from the respective moveable jaws and defining a longitudinal axis, and fixed jaws positionable upon said guide rails and facing said moveable jaws, wherein said moveable jaw assembly comprises a wedge block having inclined surfaces tangential to the longitudinal axis, the wedge block being narrower at the top than at the bottom. The moveable jaw assembly further comprises axially displaceable jaw blocks with inclined surfaces which contact flush against opposing inclined surfaces of said wedge block, and vise plates mounted on said jaw blocks. A threaded screw hole passes vertically through the center of the wedge block, and a screw is received in said threaded borehole of said wedge block and restrained against vertical movement such that turning said screw causes said wedge block to be displaced vertically and causes said jaw blocks to be displaced along the longitudinal axis.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other multi-station single action vises for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention, reference should be made to the following detailed description taken in with the accompanying drawings in which there are shown.

DETAILED DESCRIPTION OF THE INVENTION

Figure 1:
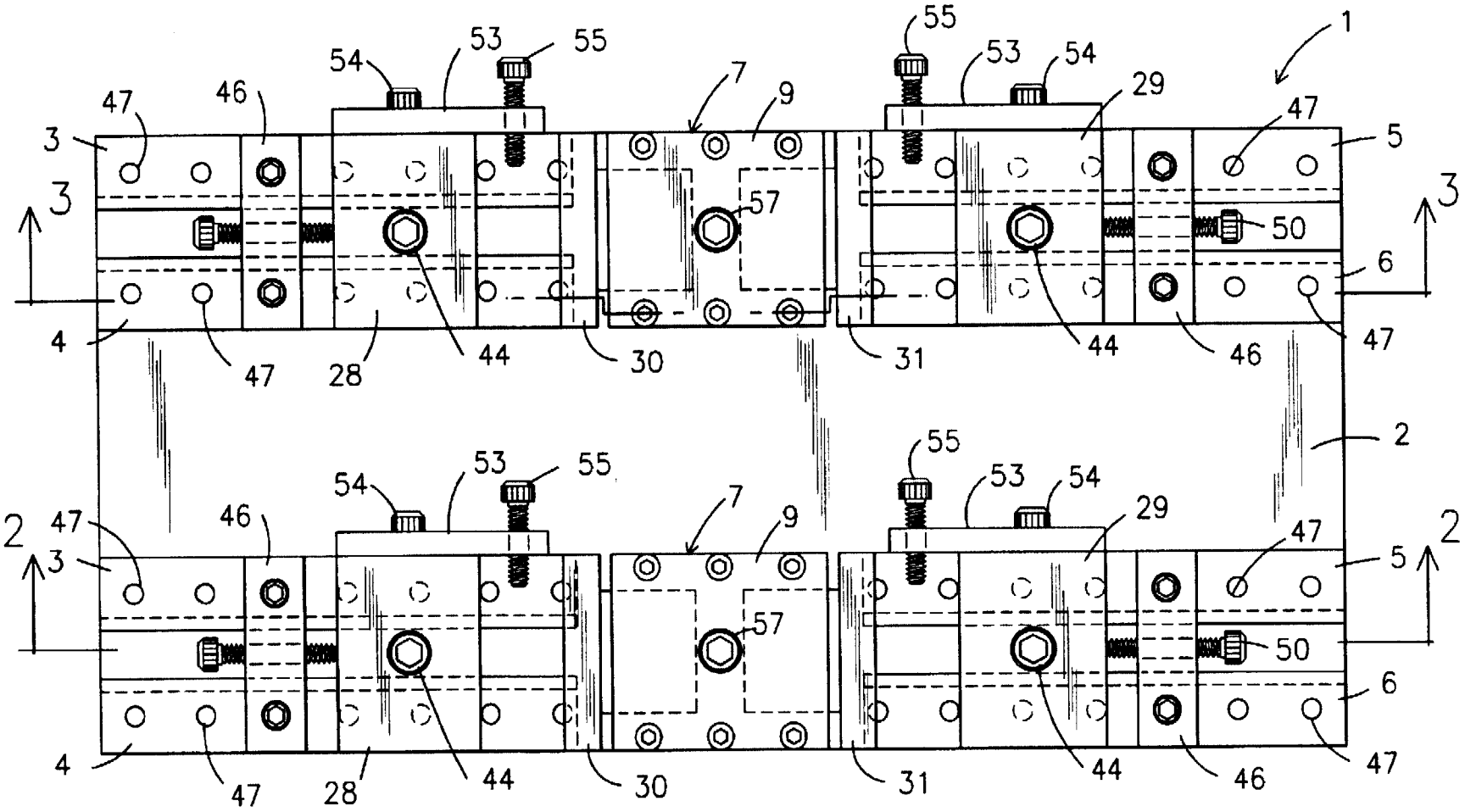
FIG. 1: a top view of a double two-station, single action vise.
Figure 2:
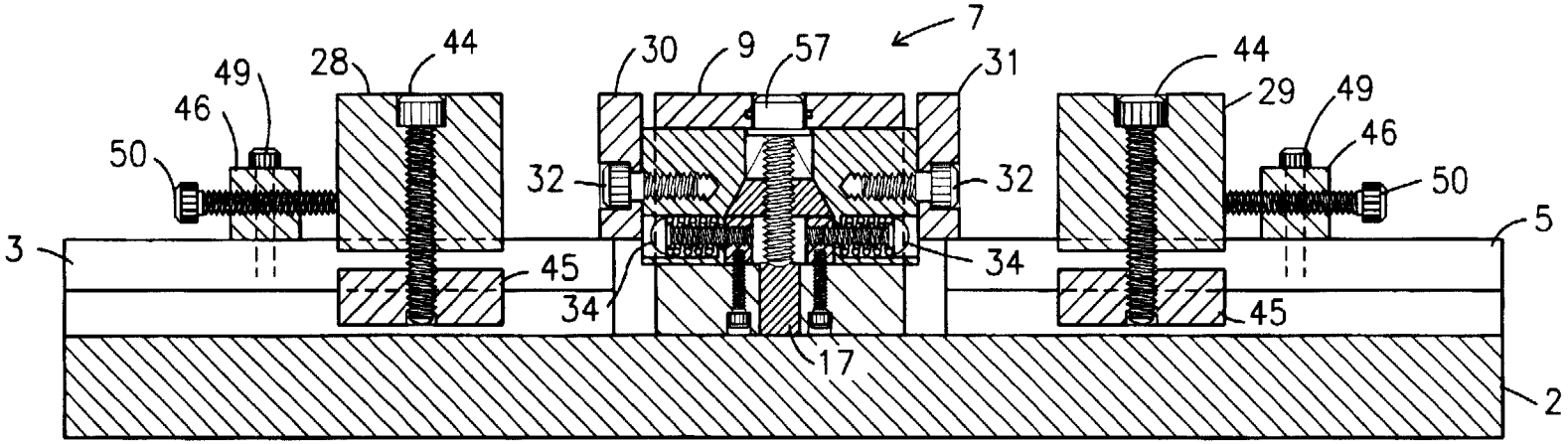
FIG. 2: a vertical cross-section through a first two-station, single action vise along line 2 in FIG. 1.
Figure 3:
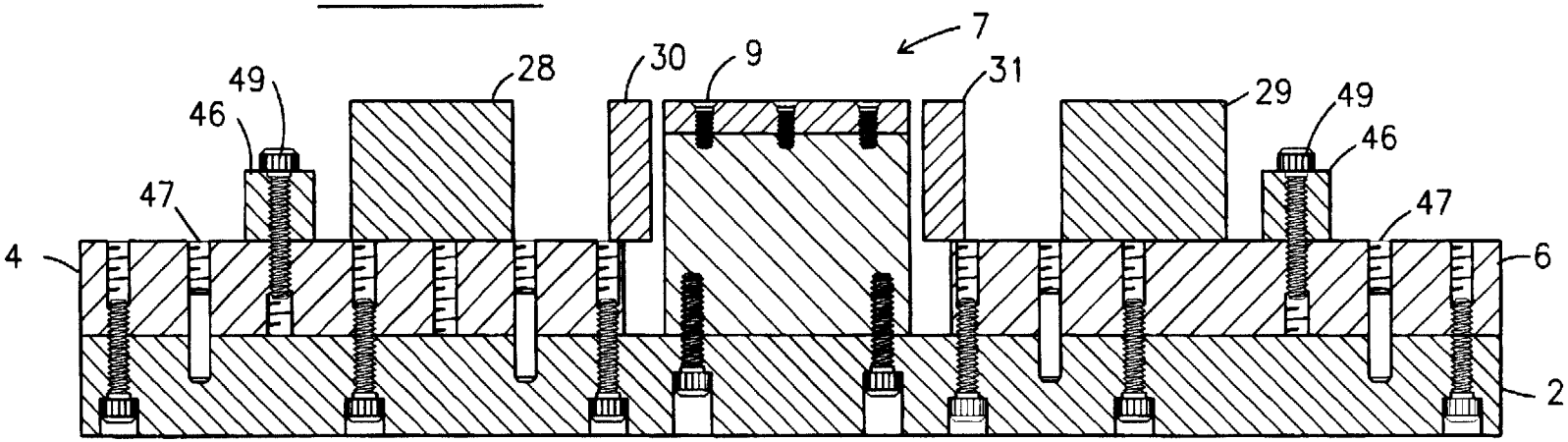
FIG. 3: a vertical cross-section through the second two-station, single action vise along line 3 of FIG. 1.

The preferred embodiment of the present invention will now be described in greater detail by reference to the example of the invention shown in the drawings, without the invention being in any way limited thereto. Although the device is shown and described with a horizontal foundation with guide rails extending horizontally (X-axis) and wedge block moving vertically (Z-axis), it is understood that reference to horizontal and vertical is for convenience with respect to the figures, and that the device could be freely reoriented when in use.

The foundation, upon which one or more two-station, single action vises can be mounted is base plate 2. In the illustrated embodiment shown in the figures, two two-station, single action vises are positioned in parallel side-by-side on a single base plate. It will be readily obvious that such vises can be provided sequentially along a single axis, or that four vises can be provided in the shape of a cross around one central wedge block.

Figure 6:
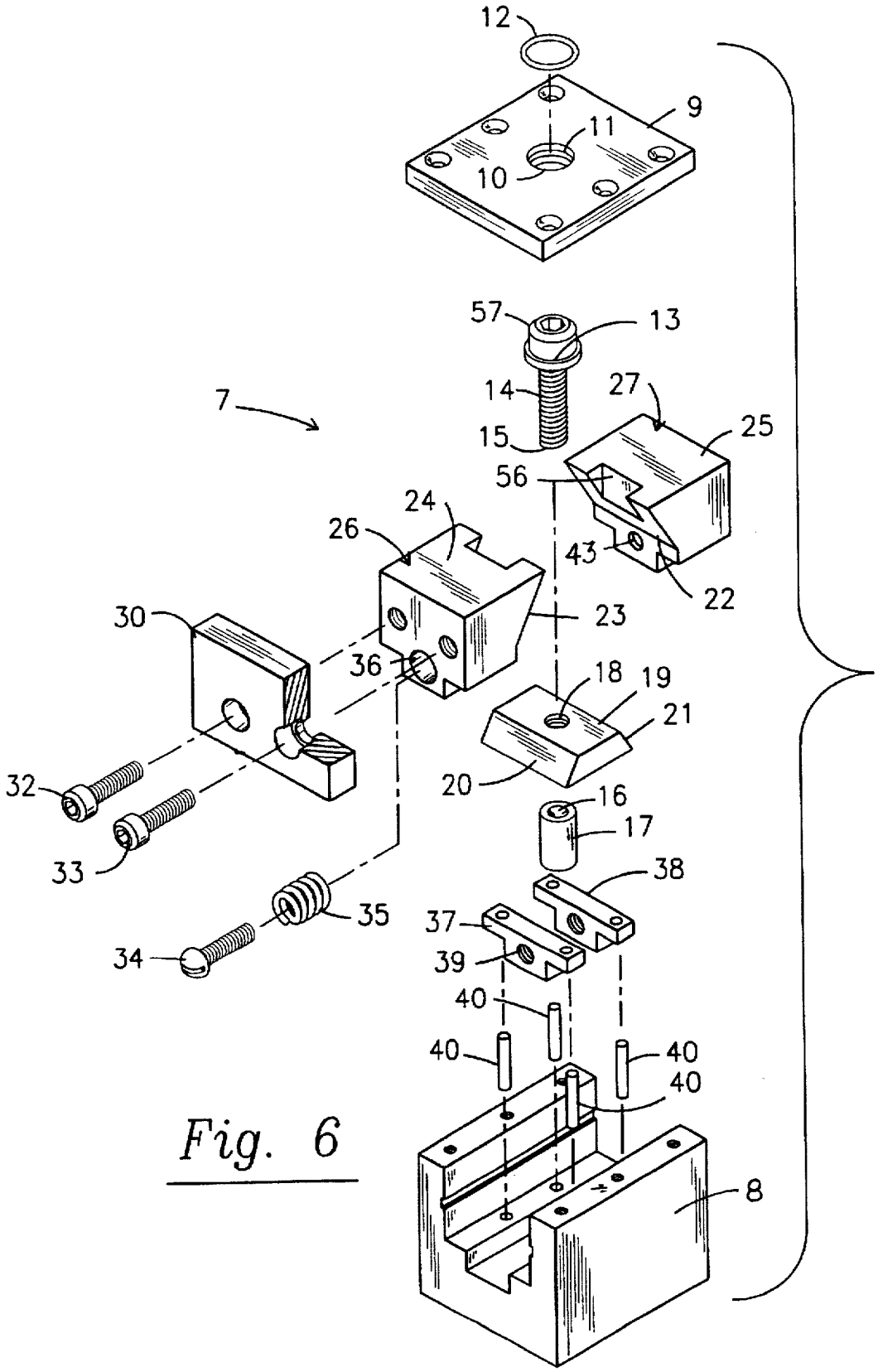
FIG. 6 shows the individual elements of the moveable jaw assembly.

With reference to the figures, the center of each two-station, single action vise 1 is a moveable jaw assembly 7. A detailed view of the individual components of the moveable jaw assembly 7 are shown in FIG. 6. The moveable jaw assembly 7 includes fixed and moveable elements. The main fixed elements of the moveable jaw assembly are casing 8 and cover plate 9. Cover plate 9 is bolted onto the top of casing 8, and the cover plate and casing provide the main framework for the moveable jaw assembly 7. Cover plate 9 has an upper surface and a lower surface. In the center of cover plate 9 is an aperture 10 including an annular groove 11 in which O-ring 12 is seated. Allen head screw 57 includes a head part 13 having a smooth outer diameter corresponding to the internal diameter of aperture 10 such that when head part 13 of the allen head screw is introduced into the aperture 10, O-ring 12 is urged against said head part 13 to form a liquid tight seal. O-ring 12 serves to prevent cooling oil or lubricant from penetrating into the inner workings of the moveable jaw assembly.

Allen head screw 57 further includes radial flange 130 which has an outer diameter greater than aperture 10 and forms a stop preventing allen head screw 57 from moving upwards. As screw 57 is rotated in the counter clockwise direction and flange 130 abuts against the lower surface of cover plate 9, threads 14 positively urge wedge block 19 downwards. In this way, any possible jamming or sticking of wedge block 19 against jaw blocks 26, 27 during retraction of the jaws is positively prevented. Allen head screw 57 further includes threading 14 and has a lower end 15 which seats upon recess 16 in hardened stop pin 13. Allen head screw 57 is thus restrained against vertical (Z-axis) movement by the flange 130 and cover plate 9 in the upwards direction, and by allen head screw lower end 15 and recess 16 in stop pin 17 in the downward direction.

External threading 14 of allen head screw 57 is dimensioned to engage with internal threading 18 in a borehole extending in the vertical (Z-) axis through wedge block 19. Rotating the screw 57 about its axis causes wedge block 19 to be displaced in the Z-axis, i.e. to ride up and down. Sides 20, 21 of wedge block 19 which face the longitudinal axis directions of the vise assembly are inclined such that wedge block 19 increases in width in the direction from cover plate towards base plate, i.e. from top towards bottom. Contacting the inclined faces 20, 21 of wedge block 19 are the oppositely inclined surfaces 22, 23 of jaw blocks 24, 25. The upper surfaces 26, 27 of jaw blocks 24, 25 contact flush against the lower surface of cover plate 9. Movement of wedge block 19 in the upwards direction forces jaw blocks 24, 25, which are pinched between wedge block 19 and cover plate 9, to be displaced outwards towards fixed jaws 28, 29. Recess 56 is provided in each jaw block order to maximize compactness and to permit jaw blocks 24, 25 to retract to the greatest extent possible without interference of screw 57. Vise plates 30, 31, which are bolted to jaw blocks 24, 25 by means of cap screws 32, 33 are displaced axially together with jaw blocks 24, 25 to which they are attached.

Figure 4:
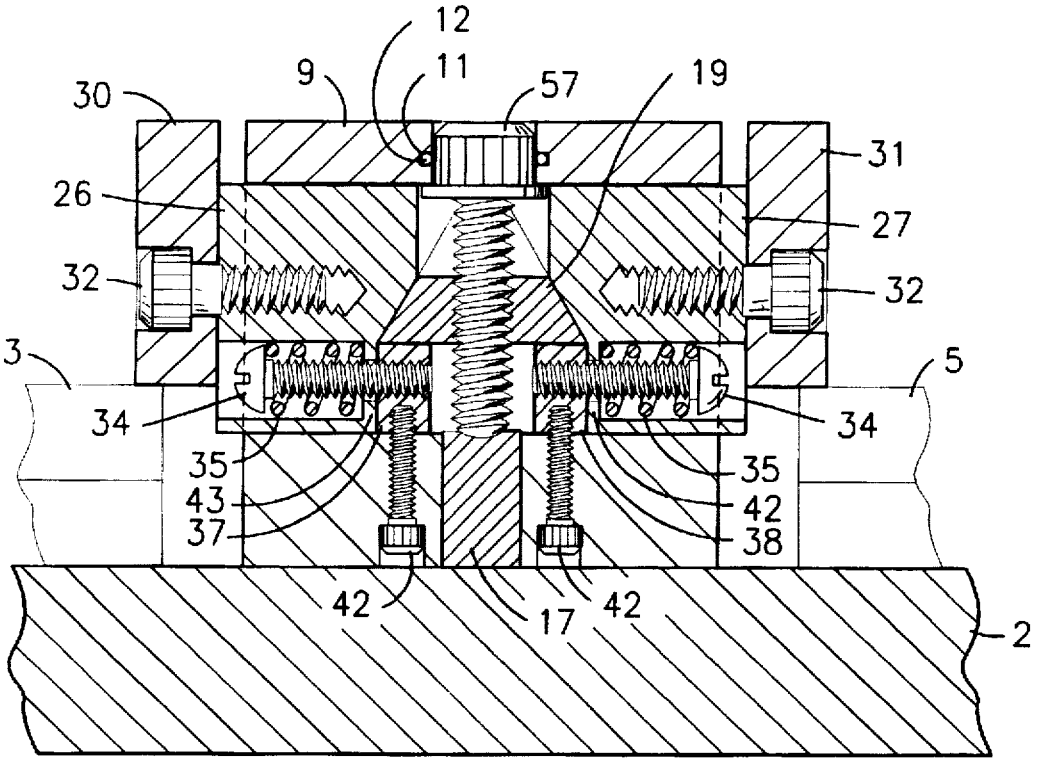
FIG. 4 a section through the moveable jaw assembly along the longitudinal axis with the wedge in the lower position and the vise plates in the retracted position.
Figure 5:
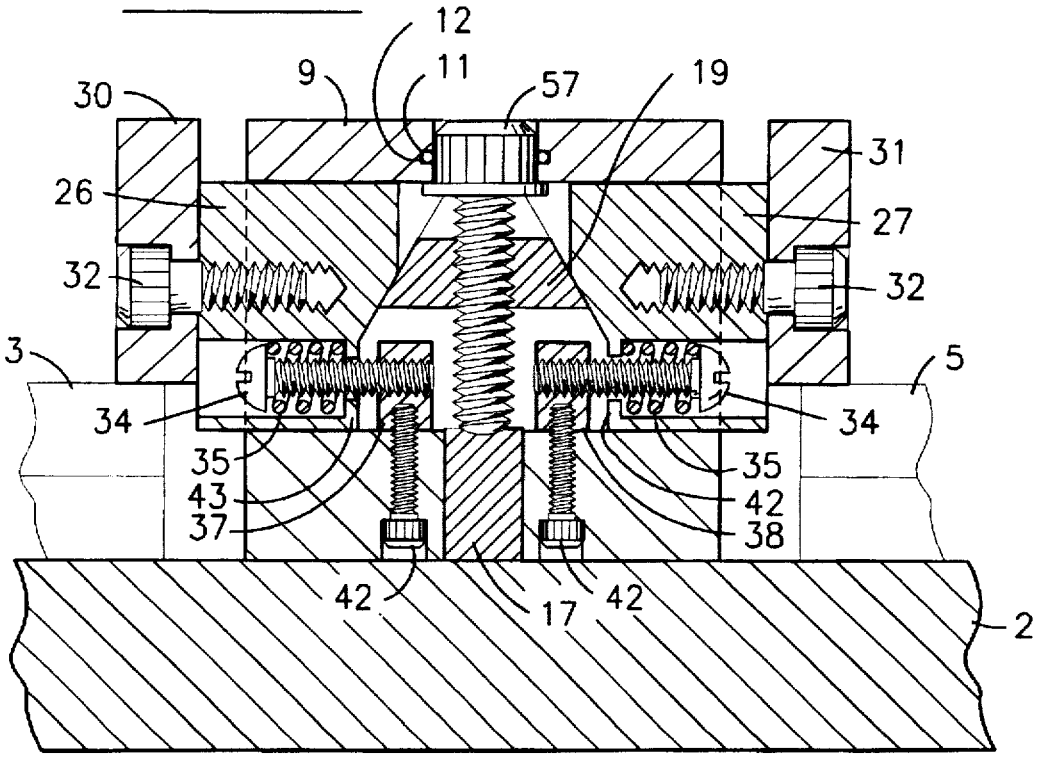
FIG. 5 a section corresponding to FIG. 4 with the wedge in the raised position and the vise plates in the extended position.

A borehole is provided along the longitudinal axis through jaw block 24 with the diameter at the distal (outer) end of the bore 36 being sufficiently large to receive spring 35 and with a diameter at the proximal (internal) side 41 of the bore being sufficient only to permit the threaded end of screw 34 to pass through. As shown in FIGS. 4 and 5, a step or constriction 43 acts as a stop for helical spring 35. In this way, spring 35 is retained in the borehole 36 between the head of screw 34 and the narrow diameter proximal side 41 of the bore hole.

Screw 34 is screwed into threaded bore 39 of register bar 37, which is shown in the figures having a shape known as a T-bar. Register bar 37 is kept in place in casing 8 by means of positioning pins 40 and threaded metal fastener 42. It is readily apparent that casing 8 is fixed, register bar 37 is fixed, and screw 34 which is screwed into threaded bore 37 of register bar 37 is also fixed and stationary. As jaw block 24 moves from the retracted position to the extended position, the restriction or step at the inner-most or proximal end 41 of the borehole is displaced along the longitudinal axis and causes spring 35 to compress against the head of screw 34. As allen head screw 57 is rotated to cause wedge block 19 to lower, the stored elastic force in spring 35 urges jaw block 24 to return to the retracted position. With wedge block 19 in the lowered positioned, there is nothing to cause displacement of jaw blocks 24, 25 to the extended position, and the force of spring 35 urges jaw block 24 against register bar 37.

As seen in FIGS. 4 and 5, register bars 37, 38 in addition to being held in place by pins 40 are secured by threaded metal fasteners 42. Vise plates 30, 31 fastened to the jaw blocks are shown as being substantially planar but may be any desired shape depending upon the outer contour of the work piece to be restrained. As shown in FIG. 4, the lower edge of the vise plate 30, 31 preferably rides along the top of guide rails 3, 5.

Figure 7:
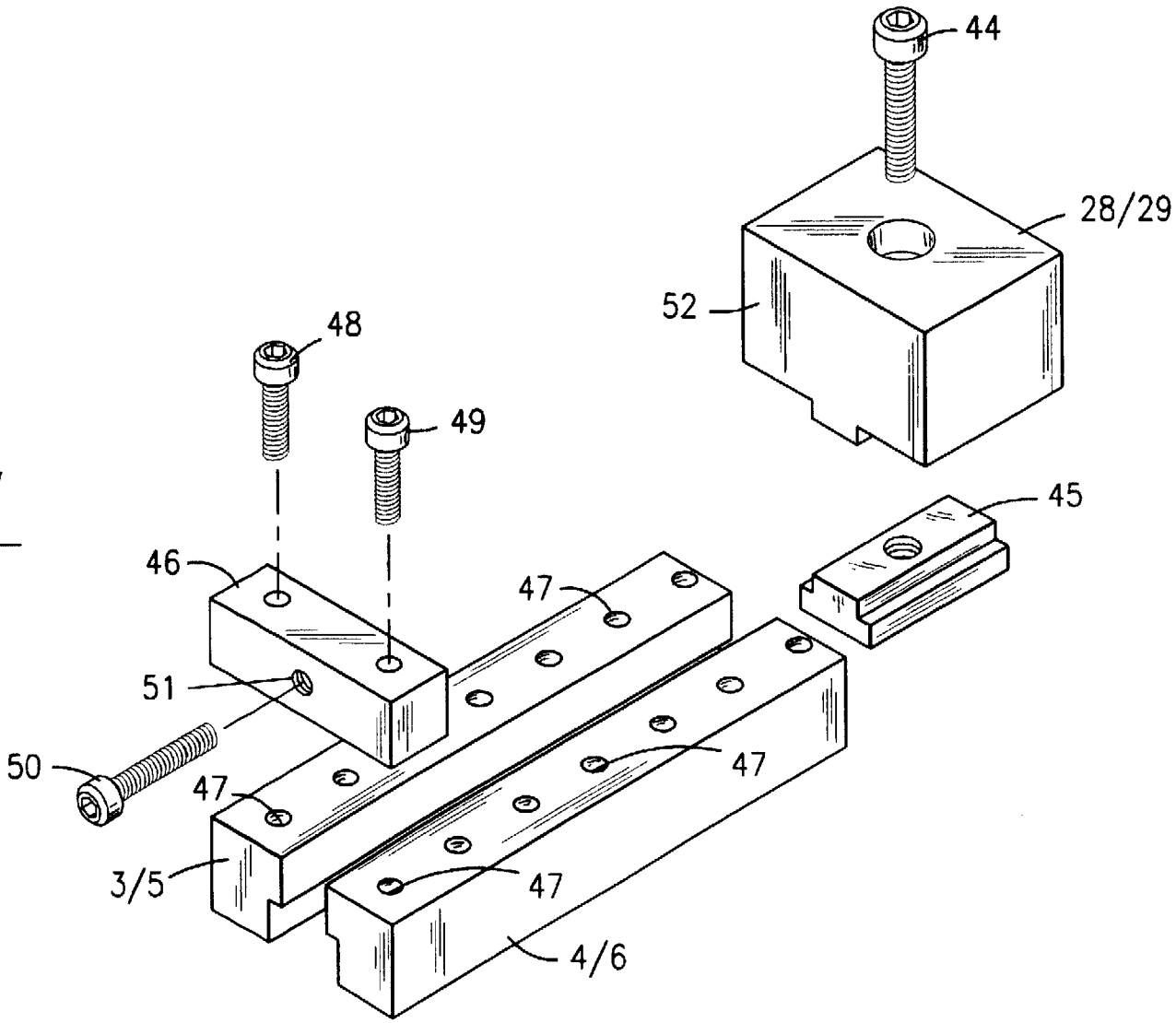
FIG. 7 shows the components of the fixed jaw back up bar to be mounted on the guide rails.

Turning next to FIG. 7, there is shown one fixed jaw of the vise according to the invention. Fixed jaw 29 is secured in place on guide rails 3, 4 by means of allen head screw 44 and T-shaped anchor block 45 which fits in a corresponding channel defined between guides 3, 4. In order to provide greater stability and strength to fixed jaw 29, back-up bar 46 is placed over threaded boreholes 47 in guide rails 3, 4 outwards of and adjacent to fixed jaw 29. Backup bar 46 is then secured in place by means of allen head screws 48, 49 and another allen head screw 50 is screwed in through borehole 51 in the direction of fixed jaw 29 until it contacts against and applies pressure to the distal surface 52 of fixed jaw 29.

The operation of the multi-station, single action high precision mechanical vise according to the present invention will now be discussed.

The total work space between the fixed jaws and vice plate as shown in the figures, into which a work piece may be inserted and secured, may be any size, but in the illustrative example it is approximately 3 inches. The moveable jaws of the moveable jaw assembly are designed to travel approximately 0.12 inches (⅛ of an inch). In order to conveniently insert or remove a work piece from the space between vise plate 31 and fixed jaw 29, it is preferred that the work piece has a clearance in the work space of approximately 0.01 inch, but 0.005 inch is entirely suitable.

In order to set up a vise for a work piece having a given dimension, a representative work piece is simply inserted in the work space and urged against retracted vise plate 31. A feeler gauge, for example, a 0.005 inch feeler gauge, is inserted between vise plate 31 and a work piece. Fixed jaw 29 is then loosely urged against the work piece and fixed jaw 29 is secured onto guide rails 3, 4 by tightening screw 44. Then, backup bar 46 is positioned over the next adjacent boreholes 47 in guide rails 3, 4 and backup bar 46 is tightened into boreholes 47 by means of screws 48, 49. Screw 50 is tightened through borehole 51 in backup bar 46 until it presses against fixed jaw 29, providing greater resistance to sheer stress or stripping stress.

The need for a backup bar is attributable to the clamping force multiplication effect of the wedge block. That is, the sheer stress or stripping stress of allen head screw 57 has a limit which can be calculated at, e.g., 9,000 lbs. By using the wedge block to convert 6 inches of vertical travel to 1 inch of horizontal travel, the effective wedging force attainable prior to reaching the screw stripping limit can be multiplied by six. In the absence of using backup bar 46, it would be difficult to prevent fixed jaws 28, 29 from being displaced outwards. When using backup bar 46, the sheer stress necessary to displace fixed jaw 29 is multiplied.

The feeler gauge is removed, the representative part is removed, and the vise is ready for machining operations.

It will be readily apparent that the size of the work piece which can be secured in the work space can vary greatly and depends simply upon the length of guide rails 3, 4, 5, 6. It will also be readily apparently that the dimensions of the work piece fastened in the first work station of a two-work station vise according to the present invention is completely independent of the dimensions of the work piece to be secured in the second work station of the two-work station vise according to the present invention. This makes it possible, for example, to secure a given work piece in a first orientation in a first work station and to machine certain features into the work piece at the first work station, then to move the work piece to a second work station and there to secure it in the different orientation with different dimensions, presenting this different face for machining in the subsequent machining step. Once fixed jaw 29 and backup bar 46 are adjusted for a particular work piece, i.e. secured such that when vise plate 31 is in the retracted position each work piece will have from 0.01 to 0.005 inch clearance in the work space, it will be insured that the work piece is positioned with high dimensioned accuracy in the X-axis, i.e., along the longitudinal axis.

In order to position the work piece properly in the Y-axis, i.e., in the horizontal axis perpendicular to the longitudinal axis, vise stop assembly 53, 55 is provided securely fixed to base plate 2 by means of threaded fastener 54. Threaded screw 55 is capable of being precisely positioned along the Y-axis by rotating and acting as a stop for accurately positioning a work piece. The upper surface of the guide rails 3, 4, 5, 6 provide the surface upon which the work piece is placed and thus serve as the stop for the work piece in the Z-axis, i.e. the vertical direction.

Once the fixed jaw 29 and backup bar 46 and vise stops unit 53, 55 is adjusted, a rapid and simplified securing of work pieces 30, for an automated work processing center may proceed.

More specifically, first and second work pieces are provided in first and second work spaces of the two work station vise accordingly to the present invention, urged against vise stop screw 55. An allen wrench is inserted in head 13 of allen head screw 57 and the screw is rotated. Rotation of allen head screw 57 in the clockwise direction will cause wedge block 19 to move upwards towards cover plate 9. The upward movement of inclined faces 20, 21 of wedge block 19 against the corresponding inclined surfaces 22, 23 of jaw blocks 24, 25 causes jaw blocks 24, 25, which are incapable of moving upwards due to cover plate 9, to be displaced outwardly along the longitudinal direction, moving vise plates 30, 31 against the work pieces. Since the gap between the vise plates and work pieces was initially identical, e.g., 0.01 inch, both vise plates 30, 31 are displaced outwards the same distance, i.e. 0.01 inch, in order to securely fasten the work pieces in place. The application of further torsional force on screw 57 causes wedge block 19 to apply holding forces against the work pieces.

Since two or more work pieces can be fastened at the same time, and since, for example, a total of four work pieces can be fastened as shown in the illustrative example, a work tool or work spindle controlled by a CNC controller is now presented with four times as many surfaces on which to work as in the case of fastening of only a single work piece. Thus, the work tool or spindle can act on four times as many work pieces without having to exchange work tools. The significance of this arrangement will now be explained. Assuming that four different work tools are necessary for working a work piece, and assuming that 10 seconds are necessary to change out a work tool on a work head or spindle, a conventional vise capable of holding a single work piece would require 16 tool change outs to process four work pieces. The work piece holder according to the present invention, in contrast, by holding four work pieces, would require only four tool change outs for each set of four work pieces. Given that the positioning speed of a CNC controlled table or workhead is approximately 400 inches per second, it will be apparent that it is about ten times faster to move a work piece than to change out a work tool. Therefore, it is advantageous to process as many work pieces with one tool as possible.

It will be readily apparent to those working in this art that four identical work pieces can be secured in the four work stations shown in FIG. 1, or that four different work pieces can be secured in the four work stations, or that different aspects of the same four work pieces can be secured in the four work stations. Further, it is possible, instead of securing work pieces themselves, to secure work piece holders or pallets carrying work pieces.

It is further evident to those working in this art that the dimensions and layout of the work piece holder according to the present invention may vary greatly depending on the requirements of specific machining center. For example, the work piece holder may be a two-station work piece holder, or two of such two work stations work piece holders can be provided in parallel side by side to secure four individual work pieces. Alternatively, two elongate work pieces can be secured perpendicularly across the work piece holder, i.e., extending across the gap between two adjacent work piece holders. This is only possible since the adjacent dual work piece holders are set up with the same (X-axis) zero reference point. Further yet, in certain applications requiring less holding forces, multiple work pieces can be stacked in each individual work station.

Once the process of machining the work pieces has been completed, releasing the work pieces is accomplished by a single step of inserting an allen wrench in allen head screw 57 and rotating the screw in the counter-clockwise direction. Rotation of screw 57 in the counter-clockwise direction will cause wedge block 19 to move away from cover plate 9 and towards the top of register bars 37, 38. Since wedge block 19 no longer displaces jaw blocks 24, 25 outwards, one end of spring 35 exerts spring force against the head of screw 34 and the other end exerts spring force against step 43 of jaw block 26, 27. As screw 34 is fixed, jaw block 26, 27 are urged by spring 35 to the retracted to starting position with the jaw blocks contacting register bars 37, 38. Since jaw blocks 26, 27 are pressed against register bars 37, 38 it is guaranteed that jaw blocks 26, 27 and thus vise plates 30, 31 are always fully retracted to the exact same starting position after every working step.

It is apparent that the dimensional stability of register bars 37, 38 contribute to the realignment of jaw blocks 24, 25 and vise plates 30, 31 after every machining cycle, and thus the two-work station vise according to the present invention is returned to the precise same starting position after every machining operation.

It has also been determined in practice that the vise according to the present invention presents a more even distribution of forces over the entire outer contact face of vise plates 30, 31 than the hitherto developed dual work-station vises, due to the unique positioning and orientation of wedge block 19 and actuating screw 57. Pulling the wedge up against the wedge jaw causes any minor non-axial displacement of the outer face of the wedge jaw, and thus the vise plate, to create a downward force on the work piece thereby to more securely hold it in place.

It has also been determined in practice that the tightening of the screw according to the present invention does not change overall alignment or dimensional accuracy of the vise, as has been the case with previous designs where the wedge block is drawn towards the base plate. Without desiring to be bound by any theory of operation, the present inventor presumes that the pushing down of the screw to cause the wedge block to move upwards imparts a slight upwards force to the inside end of the jaw blocks, which force is transmitted to the outside face of the jaw blocks and thus vise plates as a downwards force during tightening, which causes the jaw block to actually square itself as it is displaced outwards and contacts the work piece. The downwards force against the stop pin 17 is counteracted by the upwards force via the wedge block and jaw blocks against cover plate 9.

Although the multi-station single action high precision mechanical vise was described herein with great detail with respect to machining of work parts, it will be readily apparent that the vise is capable of use in a number of other applications. Although this invention has been described in its preferred form with a certain amount of particularity with respect to a specific illustrative embodiment as shown in the figures, it is understood that the present disclosure of the preferred form has been made only by way of example and that numerous changes in the details of structures and the composition of the combination may be resorted to without departing from the spirit and scope of the invention.

Now that the invention has been described,

What is claimed is:

1. A multi-station, single action high precision mechanical vise for simultaneously clamping multiple work pieces to be worked upon, said vise, when oriented horizontally, comprising:

a base including a base plate;

a moveable jaw assembly mounted centrally on said base, said moveable jaw assembly including at least two displaceable jaw blocks displaceable between an extended and a retracted position, and means for displacing said displaceable jaw blocks;

at least two fixed jaws, with one fixed jaw mounted on said base plate and spaced from each moveable jaw block in the direction of displacement of said moveable jaw block;

wherein said means for displacing said jaw blocks comprises:

a wedge block narrower at the top than at the bottom, said wedge block including identical but mirror image inclined surfaces on opposite sides of said wedge block, said inclined surfaces of said wedge block contacting corresponding faces of said moveable block jaw, such that a vertical displacement of said wedge block away from said base plate causes a horizontal displacement of said moveable jaws to the extended position, and a vertical displacement of said wedge block towards said base plate causes a horizontal displacement of said moveable jaws to the retracted position.

2. A multi-station vise as in claim 1, wherein said moveable jaw block includes a side contacting said wedge block and a clamping side opposite said side contacting said wedge block, wherein said clamping side is provided with a vise plate.

3. A multi-station vise as in claim 1, wherein said base plate includes rails extending outwards from said moveable jaw assembly along the axis of displacement of said displaceable jaw blocks, and wherein said fixed jaws are mounted on said guide rails.

4. A multi-station vise as in claim 2, wherein said side of said moveable jaw block contacting said wedge block is inclined so as to contact flush against the contacting inclined surface of said wedge block.

5. A multi-station, single action high precision mechanical vise for simultaneously clamping multiple work pieces to be worked upon, said vise, when oriented horizontally, comprising:

a base including a base plate;

a moveable jaw assembly mounted centrally on said base, said moveable jaw assembly including at least two displaceable jaw blocks displaceable between an extended and a retracted position, and means for displacing said displaceable jaw blocks;

at least two fixed jaws, with one fixed jaw mounted on said base plate and spaced from each moveable jaw block in the direction of displacement of said moveable jaw block;

wherein said means for displacing said jaw blocks comprises:

a wedge block narrower at the top than at the bottom, said wedge block including identical but mirror image inclined surfaces on opposite sides of said wedge block, said inclined surfaces of said wedge block contacting corresponding faces of said moveable block jaw, such that a vertical displacement of said wedge block away from said base plate causes a horizontal displacement of said moveable jaws to the extended position, and a vertical displacement of said wedge block towards said base plate causes a horizontal displacement of said moveable jaws to the retracted position; and wherein said moveable jaw block assembly includes a housing, and further including spring means provided in said housing for biasing said moveable jaws towards the retracted position.

6. A multi-station vise as in claim 1, wherein said wedge block includes a vertical threaded bore hole, and wherein said wedge block is displaced vertically by means of a threaded screw threaded into said bore hole.

7. A multi-station, single action high precision mechanical vise for simultaneously clamping multiple work pieces to be worked upon, said vise, when oriented horizontally, comprising:

a base including a base plate;

a moveable jaw assembly mounted centrally on said base, said moveable jaw assembly including at least two displaceable jaw blocks displaceable between an extended and a retracted position, and means for displacing said displaceable jaw blocks;

at least two fixed jaws, with one fixed jaw mounted on said base plate and spaced from each moveable jaw block in the direction of displacement of said moveable jaw block;

wherein said means for displacing said jaw blocks comprises:

a wedge block narrower at the top than at the bottom, said wedge block including identical but mirror image inclined surfaces on opposite sides of said wedge block, said inclined surfaces of said wedge block contacting corresponding faces of said moveable block jaw, such that a vertical displacement of said wedge block away from said base plate causes a horizontal displacement of said moveable jaws to the extended position, and a vertical displacement of said wedge block towards said base plate causes a horizontal displacement of said moveable jaws to the retracted position; and wherein said moveable jaw block assembly includes a housing including a wedge block access bore hole, said threaded screw includes a screw head which projects upwards through said wedge block access bore hole, and said threaded screw further includes a flange which prevents vertical upwards displacement of said screw through said wedge block access bore hole.

8. A multi-station, single action high precision mechanical vise for simultaneously clamping multiple work pieces to be worked upon, said vise, when oriented horizontally, comprising:

a base including a base plate;

a moveable jaw assembly mounted centrally on said base, said moveable jaw assembly including at least two displaceable jaw blocks displaceable between an extended and a retracted position, and means for displacing said displaceable jaw blocks;

at least two fixed jaws, with one fixed jaw mounted on said base plate and spaced from each moveable jaw block in the direction of displacement of said moveable jaw block;

wherein said means for displacing said jaw blocks comprises:

a wedge block narrower at the top than at the bottom, said wedge block including identical but mirror image inclined surfaces on opposite sides of said wedge block, said inclined surfaces of said wedge block contacting corresponding faces of said moveable block jaw, such that a vertical displacement of said wedge block away from said base plate causes a horizontal displacement of said moveable jaws to the extended position, and a vertical displacement of said wedge block towards said base plate causes a horizontal displacement of said moveable jaws to the retracted position; and wherein said threaded screw includes a lower end, and wherein said moveable jaw block assembly includes a hardened pin with a recess adapted for receiving said lower end of said thread screw, and wherein said lower end is seated in said recess of said hardened pin.

9. A multi-station vise as in claim 1, wherein said vise exhibits two working stations defined between two vise jaw pairs.

10. A multi-station vise as in claim 1, wherein said vise exhibits four working stations defined between four vise jaw pairs.

* * * * *